US010648440B2

(12) United States Patent
Toda et al.

(10) Patent No.: US 10,648,440 B2
(45) Date of Patent: May 12, 2020

(54) FUEL INJECTION VALVE

(71) Applicant: DENSO CORPORATION, Kariya, Aichi-pref. (JP)

(72) Inventors: Yuusuke Toda, Kariya (JP); Shuichi Matsumoto, Kariya (JP); Yoshinori Yamashita, Kariya (JP)

(73) Assignee: DENSO CORPORATION, Kariya (JP)

( * ) Notice: Subject to any disclaimer, the term of this patent is extended or adjusted under 35 U.S.C. 154(b) by 65 days.

(21) Appl. No.: 15/742,066

(22) PCT Filed: May 25, 2016

(86) PCT No.: PCT/JP2016/002528
§ 371 (c)(1),
(2) Date: Jan. 5, 2018

(87) PCT Pub. No.: WO2017/010034
PCT Pub. Date: Jan. 19, 2017

(65) Prior Publication Data

US 2018/0195480 A1 Jul. 12, 2018

(30) Foreign Application Priority Data

Jul. 14, 2015 (JP) ..... 2015-140771
Feb. 29, 2016 (JP) ..... 2016-037257

(51) Int. Cl.
*F02M 61/18* (2006.01)
*F02M 69/00* (2006.01)
(Continued)

(52) U.S. Cl.
CPC ..... *F02M 61/188* (2013.01); *F02M 51/06* (2013.01); *F02M 51/0603* (2013.01);
(Continued)

(58) Field of Classification Search
CPC ..... F02M 61/188; F02M 61/04; F02M 61/18; F02M 61/1873; F02M 51/0678;
(Continued)

(56) References Cited

U.S. PATENT DOCUMENTS 4,934,605 A * 6/1990 Hans ..... F02M 51/0678 239/585.4
5,383,607 A * 1/1995 Heyse ..... F02M 51/0671 239/585.4
(Continued)

FOREIGN PATENT DOCUMENTS

DE 10 2011 007 887 A1 10/2012
JP 59-070079 5/1984
(Continued)

*Primary Examiner* — Viet Le
*Assistant Examiner* — Juan C Barrera
(74) *Attorney, Agent, or Firm* — Nixon & Vanderhye P.C.

(57) ABSTRACT

A fuel injection valve includes a valve housing having an injection hole and a valve seat surface tapering toward a downstream side, a valve component that is accommodated in the valve housing and is coaxially separated from or seated on the valve seat surface, and an elastic component biasing the valve component toward the valve seat surface. The valve component includes an inner convex surface curved in a partial spherical shape with a predetermined curvature radius, and an outer convex surface that is provided continuously to the outer peripheral side of the inner convex surface and curved in a partial spherical shape having a smaller curvature radius than the inner convex surface. A boundary portion between the inner convex surface and the outer convex surface protrudes toward the valve seat surface so as to be able to be separated from or seated on the valve seat surface.

9 Claims, 12 Drawing Sheets

(51) Int. Cl.
*F02M 51/06* (2006.01)
*F02M 61/04* (2006.01)

(52) U.S. Cl.
CPC ..... *F02M 61/04* (2013.01); *F02M 61/18* (2013.01); *F02M 61/1873* (2013.01); *F02M 69/00* (2013.01)

(58) Field of Classification Search
CPC .... F02M 61/06; F02M 61/1866; F02M 51/06; F02M 51/0603; F02M 61/1886
USPC ..... 239/533.12
See application file for complete search history.

(56) References Cited

U.S. PATENT DOCUMENTS

| | | | | |
|---|---|---|---|---|
| 5,762,272 | A * | 6/1998 | Tani | F02M 51/0678 239/543 |
| 5,996,912 | A | 12/1999 | Ren et al. | |
| 2003/0141385 | A1 * | 7/2003 | Xu | F02M 61/162 239/463 |

FOREIGN PATENT DOCUMENTS

| | | |
|---|---|---|
| JP | 2003-003934 | 1/2003 |
| JP | 2006-207474 | 8/2006 |
| JP | 2009-150358 | 7/2009 |

* cited by examiner

FUEL INJECTION VALVE

This application is the U.S. national phase of International Application No. PCT/JP2016/002528 filed May 25, 2016, which designated the U.S. and claims priority to Japanese Patent Applications No. 2015-140771 filed on Jul. 14, 2015, and No. 2016-37257 filed on Feb. 29, 2016, the entire contents of each of which are incorporated herein by reference.

CROSS REFERENCE TO RELATED APPLICATION

This application is based on Japanese Patent Applications No. 2015-140771 filed on Jul. 14, 2015, and No. 2016-37257 filed on Feb. 29, 2016, the disclosure of which is incorporated herein by reference.

TECHNICAL FIELD

The present disclosure relates to a fuel injection valve that injects fuel into an internal combustion engine.

BACKGROUND ART

Conventionally, it is well known that a fuel injection valve has a valve component which is accommodated in a valve housing, whose valve seat surface tapers toward a downstream side from an upstream side with respect to an injection hole that injects fuel. In such a fuel injection valve, the valve component biased by an elastic component is separated from or seated on the valve seat surface for valve opening or valve closing, allowing intermittent fuel injection from the injection hole.

For example, a valve component of a fuel injection valve disclosed in Patent Literature 1 has an inner tapered surface having a large taper angle and an outer tapered surface having a small taper angle continuing to an outer peripheral of the inner tapered surface, and the boundary portion between the tapered surfaces is separated from or seated on a tapered valve seat surface. A valve component of a fuel injection valve disclosed in Patent Literature 2 has a convex curved surface curved in a partial spherical shape with a predetermined curvature radius, and an intermediate portion in a radial direction of the convex curved surface is separated from or seated on a tapered valve seat surface.

However, in the fuel injection valve disclosed in Patent Literature 1, the boundary portion between the inner tapered surface and the outer tapered surface protrudes sharply toward the valve seat surface. In the valve component biased toward the valve seat surface by the elastic component, therefore, the sharp boundary portion collides with the valve seat surface during valve closing operation, which excessively increases dynamic contact pressure generated between the boundary portion and the valve seat surface. Such an increase in dynamic contact pressure results in wear of the boundary portion and the valve seat surface, which may cause fuel leakage from between the boundary portion and the valve seat surface in a valve closed state after the valve closing operation.

In the fuel injection valve disclosed in Patent Literature 2, the smooth convex curved surface having a partially spherical shape is seated on the valve seat surface to establish a valve closed state. Hence, the static contact pressure generated between the convex curved surface and the valve seat surface is also reduced in the valve closed state of the valve component biased toward the valve seat surface by the elastic component. Such a reduction in static contact pressure undesirably tends to cause fuel leakage from between the boundary portion and the valve seat surface in the valve closed state.

In particular, when fuel is injected at a relatively low fuel pressure into an intake port of an internal combustion engine and thus the valve component is pressed toward the valve seat at a decreased force due to the low fuel pressure, the fuel leakage conspicuously may occur.

PRIOR ART LITERATURES

Patent Literature

Patent Literature 1: JP 2009-150358A
Patent Literature 2: JP 2003-3934A

SUMMARY OF INVENTION

An object of the present disclosure is to provide a fuel injection valve that suppresses fuel leakage in a valve closed state.

According to a first aspect of the present disclosure, a fuel injection valve includes a valve housing having an injection hole injecting fuel into an internal combustion engine and a valve seat surface tapering toward a downstream side from an upstream side with respect to the injection hole, a valve component that is accommodated in the valve housing and is coaxially separated from or seated on the valve seat surface for valve opening or valve closing to allow intermittent fuel injection from the injection hole, and an elastic component biasing the valve component toward the valve seat surface. The valve component includes an inner convex surface curved in a partial spherical shape with a predetermined curvature radius, and an outer convex surface that is provided continuously to the outer peripheral of the inner convex surface and curved in a partial spherical shape having a smaller curvature radius than the inner convex surface. A boundary portion between the inner convex surface and the outer convex surface protrudes toward the valve seat surface so as to be able to be separated from or seated on the valve seat surface.

As described above, in the valve component of the first aspect, the outer convex surface curved in a partial spherical shape with a smaller curvature radius than the inner convex surface is provided continuously to the outer peripheral of the inner convex surface curved in a partial spherical shape with a predetermined curvature radius. As a result, the boundary portion between the inner convex surface and the outer convex surface has a shape reduced in sharpness while protruding toward the valve seat surface. Hence, it is possible to increase the static contact pressure between the boundary portion and the valve seat surface in the valve closed state in which the boundary portion is seated on the valve seat surface within a suppressible range of wear due to an excessive increase in dynamic contact pressure during valve closing operation in which the boundary portion collides with the valve seat surface. Consequently, it is possible to suppress fuel leakage from between the boundary portion and the valve seat surface in the valve closed state.

According to a second aspect of the present disclosure, the injection hole of the first aspect injects fuel into an intake port of an internal combustion engine.

In such a second aspect, even if the valve component in the valve closed state is pressed to the valve seat surface at a decreased pressing force due to a relatively low fuel pressure of the fuel injected into the intake port, the function of the first aspect on the dynamic contact pressure and the static contact pressure can be exhibited between the boundary portion and the valve seat surface. Consequently, it is also possible to suppress fuel leakage in the valve closed state under a configuration of a relatively low fuel pressure of the injected fuel.

BRIEF DESCRIPTION OF DRAWINGS

The above and other objects, features and advantages of the present disclosure will become more apparent from the following detailed description made with reference to the accompanying drawings, in which.

EMBODIMENTS FOR CARRYING OUT INVENTION

Hereinafter, one embodiment of the present disclosure will be described with reference to drawings.

Figure 1:
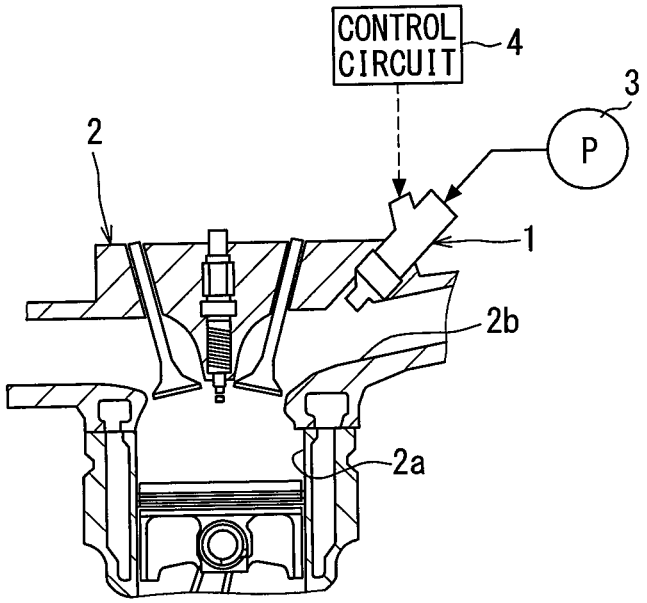
FIG. 1 is a structural view illustrating an internal combustion engine in which a fuel injection valve of one embodiment is mounted.

As shown in FIG. 1, a fuel injection valve 1 as one embodiment of the present disclosure is provided to an internal combustion engine 2 that combusts gasoline in a cylinder 2*a*. The fuel injection valve 1 injects the fuel into an intake port 2*b* through which the fuel and intake air are introduced into the cylinder 2*a*.

(Basic Configuration)

Figure 2:
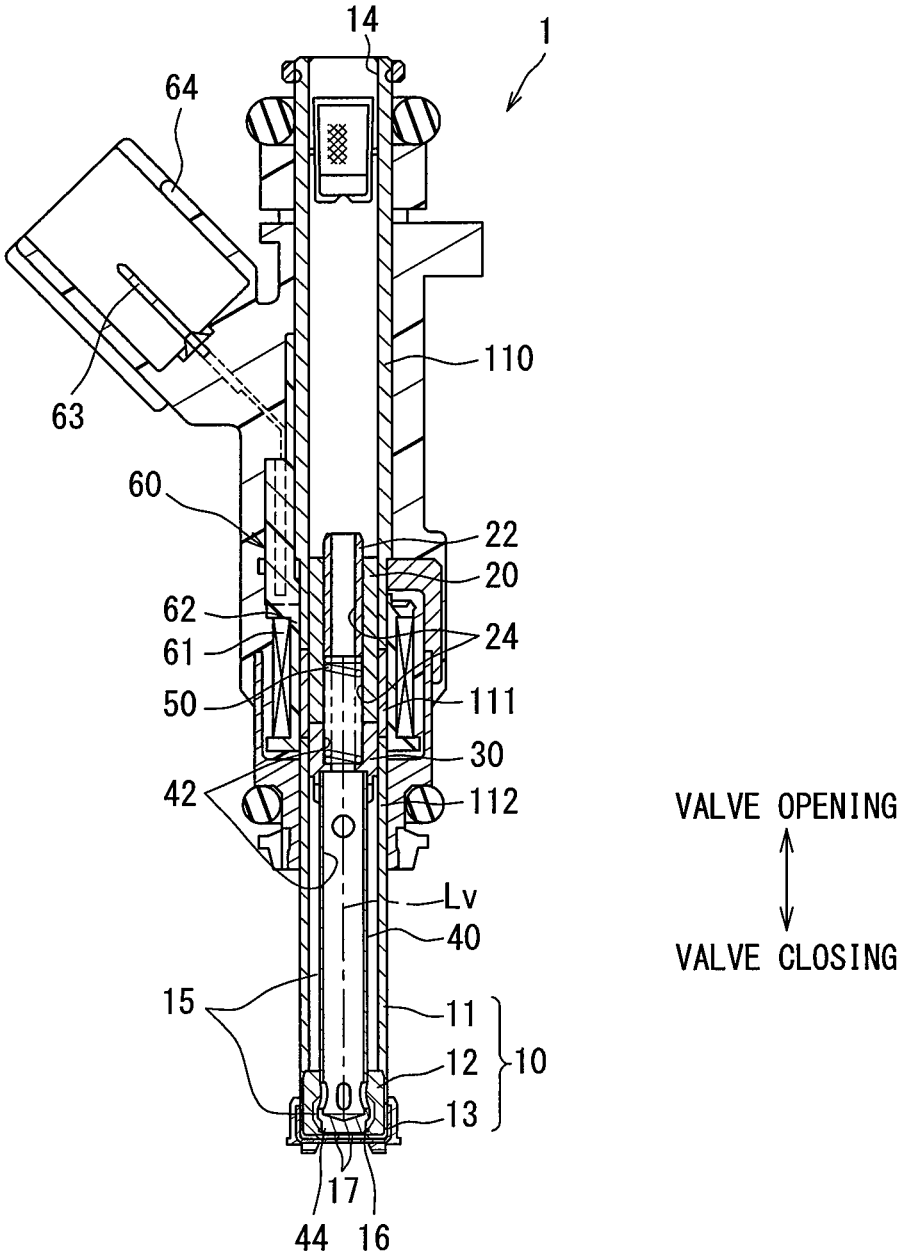
FIG. 2 is a longitudinal sectional view illustrating the fuel injection valve of the one embodiment.

A basic configuration of the fuel injection valve 1 is described. As shown in FIG. 2, the fuel injection valve 1 includes a valve housing 10, a stationary core 20, a movable core 30, a valve component 40, an elastic component 50, and a drive part 60.

The valve housing 10 is configured by a pipe component 11, a valve seat component 12, an injection hole component 13, and the like. The cylindrical pipe component 11 has a first magnetic portion 110, a nonmagnetic portion 111, and a second magnetic portion 112 in this order from a valve opening side to a valve closing side in an axial direction. The magnetic portions 110 and 112 made of a metallic magnetic material are coaxially coupled to the nonmagnetic portion 111 made of a metallic nonmagnetic material by laser welding, for example. Through such a coupling structure, the nonmagnetic portion 111 blocks short circuit of magnetic flux between the first magnetic portion 110 and the second magnetic portion 112.

Figure 3:
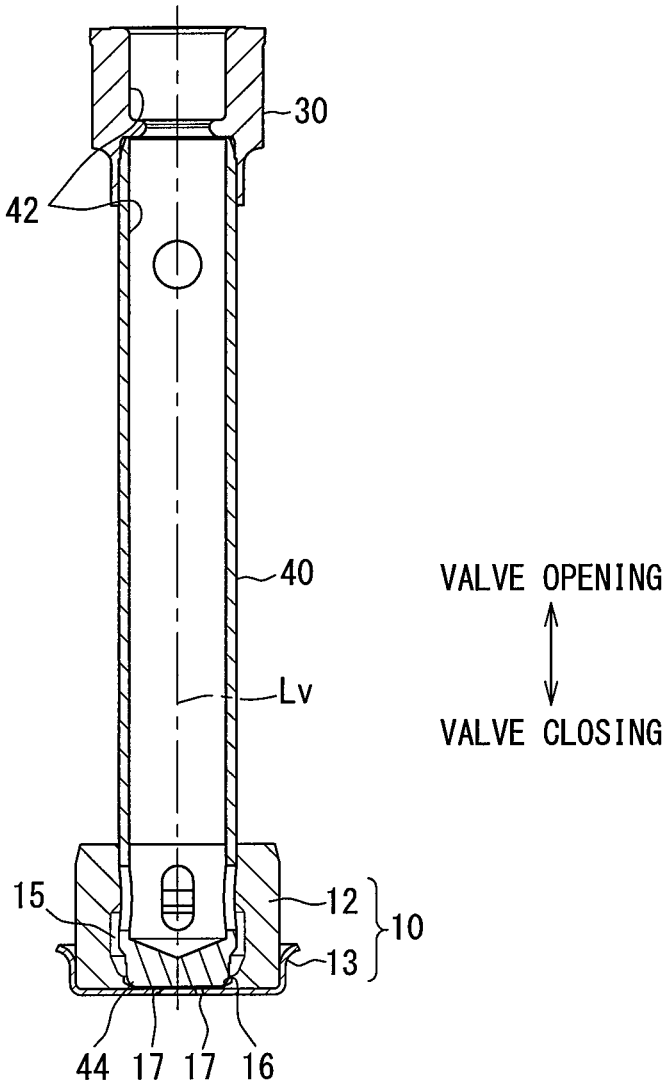
FIG. 3 is a longitudinal sectional view of FIG. 2 illustrated in a partially enlarged manner.
Figure 4:
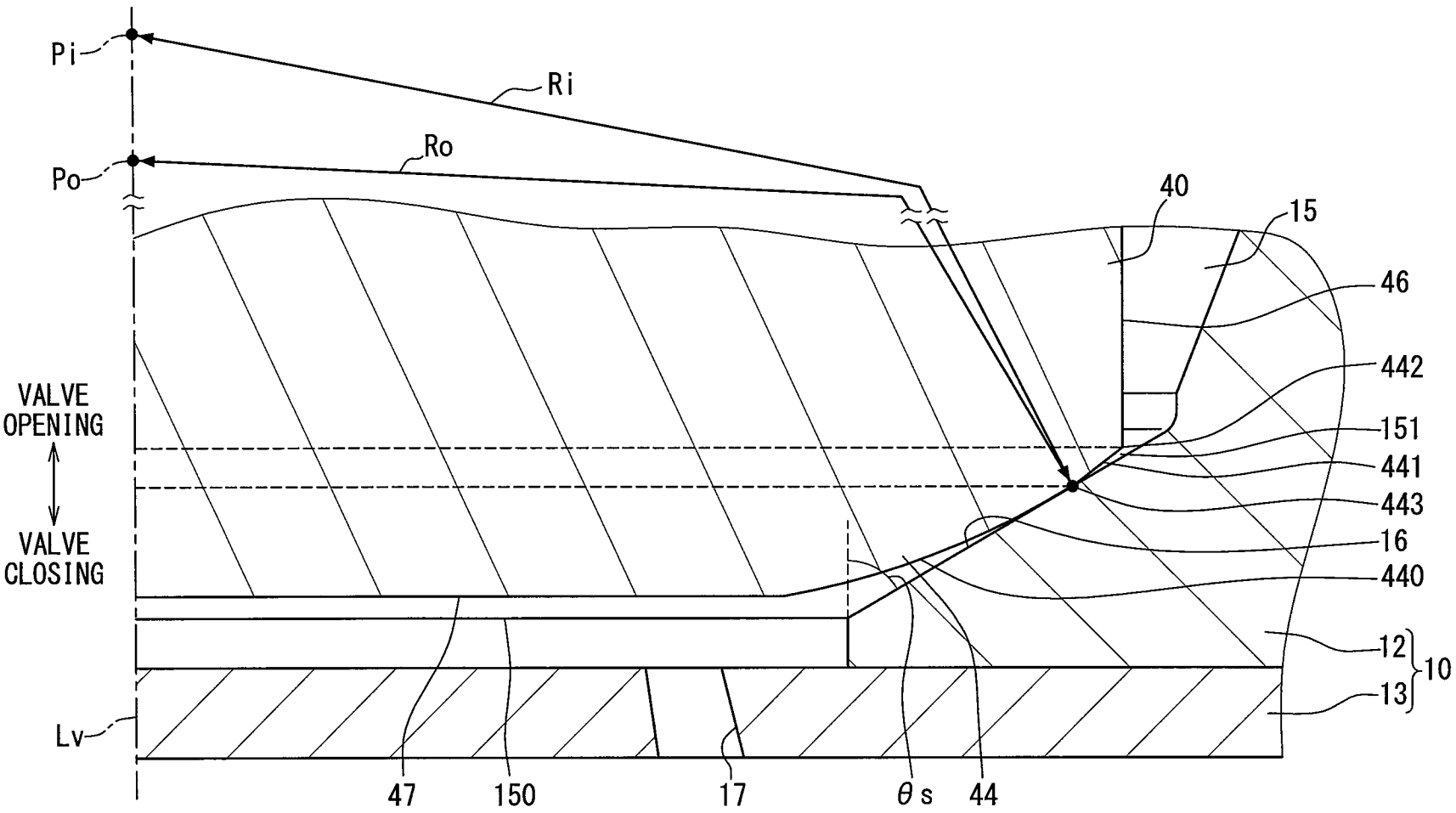
FIG. 4 is a longitudinal sectional view of a contact portion of FIG. 2 or 3 illustrated in a partially enlarged manner.

The first magnetic portion 110 forms a supply inlet 14 that receives fuel supply from a fuel pump 3 (see FIG. 1). The valve seat component 12 made of metal is cylindrically shaped and is coaxially fitted in the second magnetic portion 112. The valve seat component 12 forms a fuel passage 15 in cooperation with the pipe component 11 so as to allow the fuel to flow from an upstream side to a downstream side therein. In addition, the valve seat component 12 has a valve seat surface 16 exposed in the fuel passage 15 as shown in FIGS. 2 to 4. The valve seat surface 16 has a taper shape that tapers toward the downstream side of the fuel passage 15, and specifically has a tapered surface shape (conical surface shape) having a constant taper rate in the present embodiment.

The injection hole component 13 made of metal is cup-shaped and is coaxially fitted on the valve seat component 12 at a side opposite to the second magnetic portion 112. The injection hole component 13 has a plurality of injection holes 17 in its bottom portion. Each injection hole 17 communicates with the fuel passage 15 on the downstream side with respect to the valve seat surface 16 and radially opens toward the intake port 2*b* (see FIG. 1).

As shown in FIG. 2, the stationary core 20 made of magnetic material is cylindrically shaped and is fitted in the first magnetic portion 110 and the nonmagnetic portion 111 in a fixed manner. An adjusting pipe 22 made of a cylindrical metal is coaxially press-fitted in the stationary core 20. The stationary core 20 forms a stationary passage 24 in cooperation with the adjusting pipe 22 such that the fuel flowing from the supply inlet 14 on the upstream side flows out to the downstream side.

The movable core 30 made of metal is cylindrically shaped and is coaxially accommodated in the nonmagnetic portion 111 and the second magnetic portion 112. The movable core 30 is reciprocally movable to both sides in the axial direction on the valve closing side with respect to the stationary core 20. The valve component 40 made of nonmagnetic metal is cup-shaped and is coaxially and continuously accommodated in the second magnetic portion 112 and the valve seat component 12. As shown in FIGS. 2 and 3, the valve component 40 is fitted in the movable core 30. As a result, the valve component 40 is reciprocally movable integrally with the movable core 30 to both sides in the axial direction along a valve center line Lv thereof. The valve component 40 forms a movable passage 42 in cooperation with the movable core 30 so as to guide the fuel flowing out from the upstream stationary passage 24 to the downstream fuel passage 15.

The valve component 40 has a contact portion 44, which reciprocates on the upstream side with respect to the valve seat surface 16, at its bottom portion on the valve closing side. As shown in FIGS. 2 to 4, the valve component 40 coaxially separates or seats the contact portion 44 from/on the valve seat surface 16 having the taper shape on the upstream side with respect to all the injection holes 17. Specifically, the valve component 40 moves to the valve opening side and thus separates the contact portion 44 from the valve seat surface 16 over the entire periphery. As a result, the valve component 40 is opened and thus each injection hole 17 communicates with the fuel passage 15, so that fuel is injected from the injection hole 17 into the intake port 2*b* (see FIG. 1). On the other hand, the valve component 40 moves to the valve closing side, and thus seats the contact portion 44 on the valve seat surface 16 over the entire periphery. As a result, the valve component 40 is closed and thus the communication between each injection hole 17 and the fuel passage 15 is blocked, so that the fuel injection from the injection hole 17 is stopped. In this way, the valve component 40 is opened and closed through separation and seating from/on the valve seat surface 16, allowing intermittent fuel injection from the injection holes 17.

As shown in FIG. 2, the elastic component 50 is a compression coil spring made of metal and is coaxially accommodated in the respective passages 24 and 42 in the stationary core 20 and the movable core 30. The elastic component 50 is held between the adjusting pipe 22 in the stationary core 20 and the movable core 30. Through such a holding structure, the elastic component 50 generates an elastic restoring force corresponding to compression between the elements 22 and 30, thereby biases the movable core 30 and the valve component 40 toward the valve seat surface 16 on the valve closing side. That is, the elastic restoring force generated by the elastic component 50 corresponds to the biasing force biasing the movable core 30 and the valve component 40.

The drive part 60 is configured by a solenoid coil 61, a spool 62, a terminal 63, a connector 64, and the like. The solenoid coil 61 is formed by winding a metal wire rod around the spool 62 made of a cylindrical resin. The solenoid coil 61 is coaxially and externally fitted on the magnetic portions 110 and 112 and the nonmagnetic portion 111 through the spool 62. The terminal 63 made of metal is embedded in the connector 64 made of resin and electrically connects an external control circuit 4 (see FIG. 1) to the internal solenoid coil 61. Through such an electrical connection, energization of the solenoid coil 61 can be controlled by the control circuit 4.

In the valve opening operation of the fuel injection valve 1 configured as described above, when the solenoid coil 61 is energized and excited by the control circuit 4, the magnetic flux is guided to the first magnetic portion 110, the stationary core 20, the movable core 30, and the second magnetic portion 112. As a result, a magnetic attractive force is generated between the cores 20 and 30 confronting each other so as to attract the movable core 30 toward the stationary core 20 on the valve opening side. The movable core 30 is then driven together with the valve component 40 to the valve opening side against the biasing force of the elastic component 50. Hence, the movable core 30 is brought into contact with the stationary core 20 and locked. At this time, since the valve component 40 separates the contact portion 44 from the valve seat surface 16, fuel is injected from the injection holes 17.

In the valve closing operation after such valve opening operation, the control circuit 4 stops energization of the solenoid coil 61, and thus the solenoid coil 61 is demagnetized, so that the magnetic attraction force between the cores 20 and 30 disappears. Since the movable core 30 is then moved together with the valve component 40 to the valve closing side by the biasing force of the elastic component 50, the valve component 40 is brought into contact with the valve seat component 12 and locked. As a result, the valve component 40 seats the contact portion 44 on the valve seat surface 16, so that the fuel injection from the injection holes 17 is stopped. The valve component 40 closed in this way is biased toward the valve seat surface 16 by the fuel pressure acting on the contact portion 44 from the fuel in the movable passage 42 in addition to the biasing force of the elastic component 50.

(Detailed Configuration of Valve Component)

A detailed configuration of the valve component 40 will be described with reference to FIGS. 4 to 6. FIG. 4 illustrates one of longitudinal sections cut out including a valve center line Lv assumed to extend along the radially center of the valve component 40. In the following description, therefore, any longitudinal section on the valve component 40, including the longitudinal section of FIG. 4, is simply referred to as a longitudinal section.

As shown in FIG. 4, the valve component 40 has a valve peripheral surface 46 extending straight in a cylindrical surface shape (thereby forming a cylindrical portion of the valve component 40) about the valve center line Lv on the outer peripheral side and the valve opening side of the contact portion 44. In addition, the valve component 40 has an end surface 47 having a convex curved surface shape or a planar shape on the inner circumferential side and the valve closing side of the contact portion 44. Further, the valve component 40 coaxially has two convex surfaces 440 and 441 curved in a partial spherical shape over the entire periphery of the contact portion 44. As shown in FIG. 4, the valve component 40 therefore includes a valve peripheral surface 46 forming a cylindrical portion and a tip end, wherein the tip end includes the end surface 47, two convex surfaces 440 and 441, and a boundary portion 443 between the two convex surfaces 440 and 441.

The inner convex surface 440 continues from the end surface 47 to the outer peripheral side and to the valve opening side. As a result, the end surface 47, which is located on the downstream side with respect to the inner convex surface 440, forms a flat sack chamber 150, which guides the fuel to each injection hole 17 during valve opening, as a part of the fuel passage 15 between the end surface 47 and the injection hole component 13 of the valve housing 10. The inner convex surface 440 has a predetermined curvature radius Ri and has an arcuate section defining a curvature center position Pi on the longitudinal section. The curvature center position Pi of the inner convex surface 440 is defined on the valve center line Lv of the valve component 40. That is, the inner convex surface 440 is aligned with the valve center line Lv and located coaxially with the valve outer peripheral surface 46.

The outer convex surface 441 continues from the valve outer peripheral surface 46 to the valve inner peripheral side and to the valve closing side. As a result, the outer convex surface 441 has a bent portion 442, which bends sharply from the valve outer peripheral surface 46, over the entire periphery. The outer convex surface 441 continues from the inner convex surface 440 to the outer side and to the valve opening side. As a result, the outer convex surface 441 has a boundary portion 443 with the inner convex surface 440 over the entire periphery. The boundary portion 443 protrudes toward the valve seat surface 16 of the valve seat component 12 in the valve housing 10, over the entire periphery.

The outer convex surface 441 has a curvature radius Ro smaller than the curvature radius Ri of the inner convex surface 440 and has an arcuate section defining a curvature center position Po on the longitudinal section. The curvature center position Po of the outer convex surface 441 is defined on the valve closing side with respect to the curvature center position Pi of the inner convex surface 440 on the valve center line Lv. That is, the outer convex surface 441 is aligned with the valve center line Lv and located coaxially with the valve outer peripheral surface 46. Hence, the boundary portion 443 having a protruding shape, which is formed by the outer convex surface 441 and the inner convex surface 440, is also aligned with the valve center line Lv and located coaxially with the valve outer peripheral surface 46. Consequently, the boundary portion 443 can be separated from or seated on the tapered valve seat surface 16 having a taper angle, which is two times as large as the angle indicated by θs in FIG. 4 and is about 120° in the present embodiment, over the entire periphery. This improves aligning and stability of the boundary portion 443 seated on the tapered valve seat surface 16.

Figure 5:
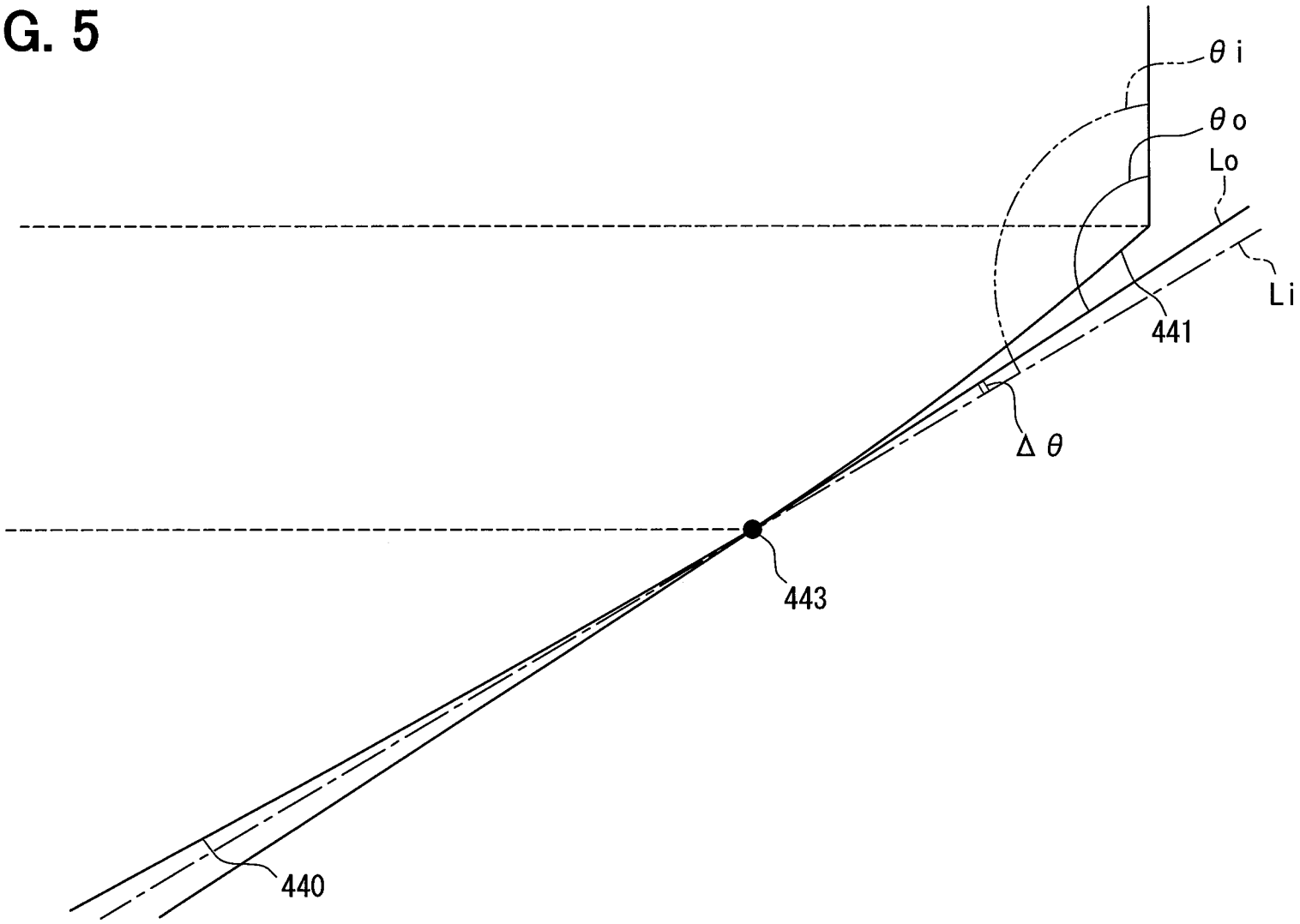
FIG. 5 is a schematic view for explaining a configuration of the contact portion of FIG. 2 or 3.
Figure 6:
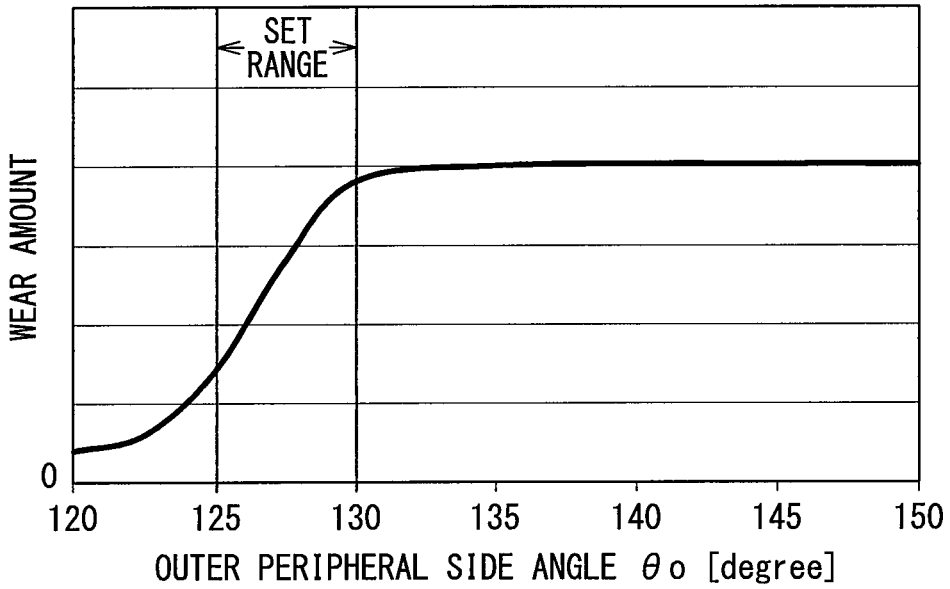
FIG. 6 is a graph for explaining the configuration of the contact portion of FIG. 2 or 3.

On the longitudinal section of the present embodiment, as shown in FIG. 5, a tangent line to the outer convex surface 441, which is assumed to extend through the boundary portion 443, is defined as outer peripheral tangent line Lo. As shown in FIG. 5, an angle formed by the outer peripheral tangent line Lo and the valve outer peripheral surface 46 on the longitudinal section is defined as outer peripheral side angle θo. Under such definitions on the outer convex surface 441, as shown in FIG. 6, the outer peripheral side angle θo is set within a range from 125° to 130°, preferably from 125° to 128°, and more preferably set to about 125.5°. For the outer peripheral side angle θo of less than 125°, since the outer convex surface 441 becomes close to the valve seat surface 16 and thus easily comes into contact therewith, the outer peripheral side angle θo of 125° or more is used to suppress a reduction in static contact pressure in the valve closed state due to such contact. On the other hand, for the outer peripheral side angle θo of more than 130°, since the boundary portion 443 increased in sharpness collides with the valve seat surface 16 and thus easily wears as shown in FIG. 6, the outer peripheral side angle θo of 130° or less is used to suppress an excessive increase in dynamic contact pressure causing such wear. The wear amount shown on the vertical axis in FIG. 6 is represented by the maximum depth in the axial direction of a recess caused by wear of the valve seat surface 16 through a predetermined number of valve closing operations under a certain fuel pressure.

Figure 7:
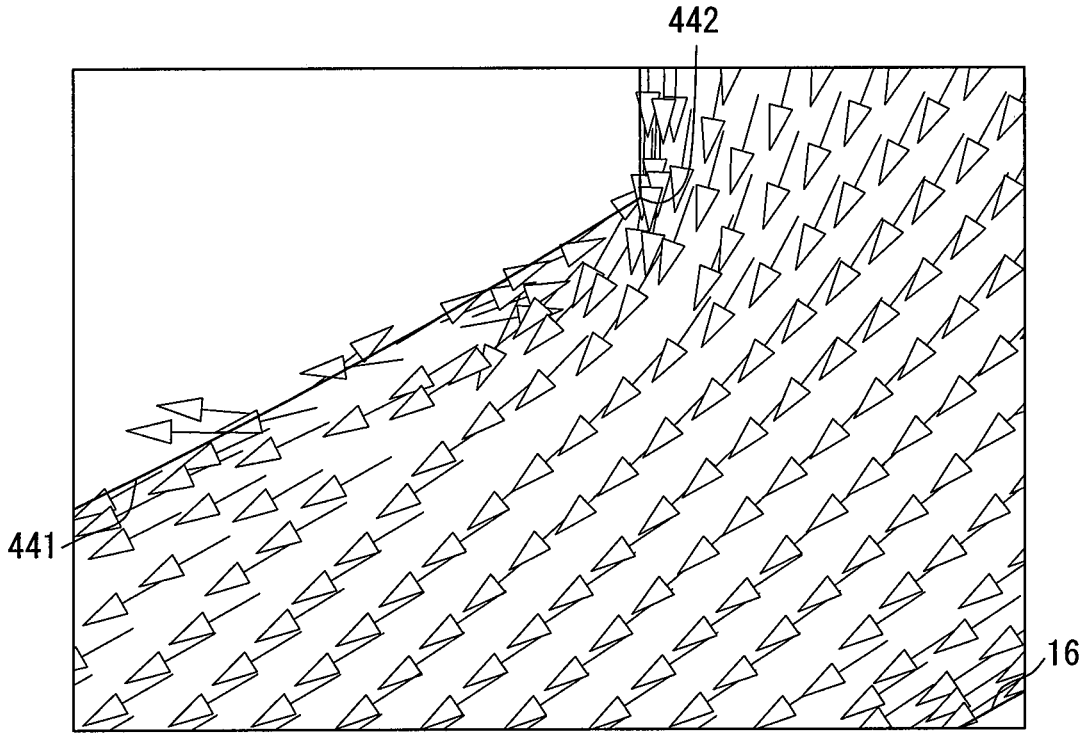
FIG. 7 is a schematic view for explaining a principle of adhesion of a deposit to an outer convex surface of FIG. 4.
Figure 8:
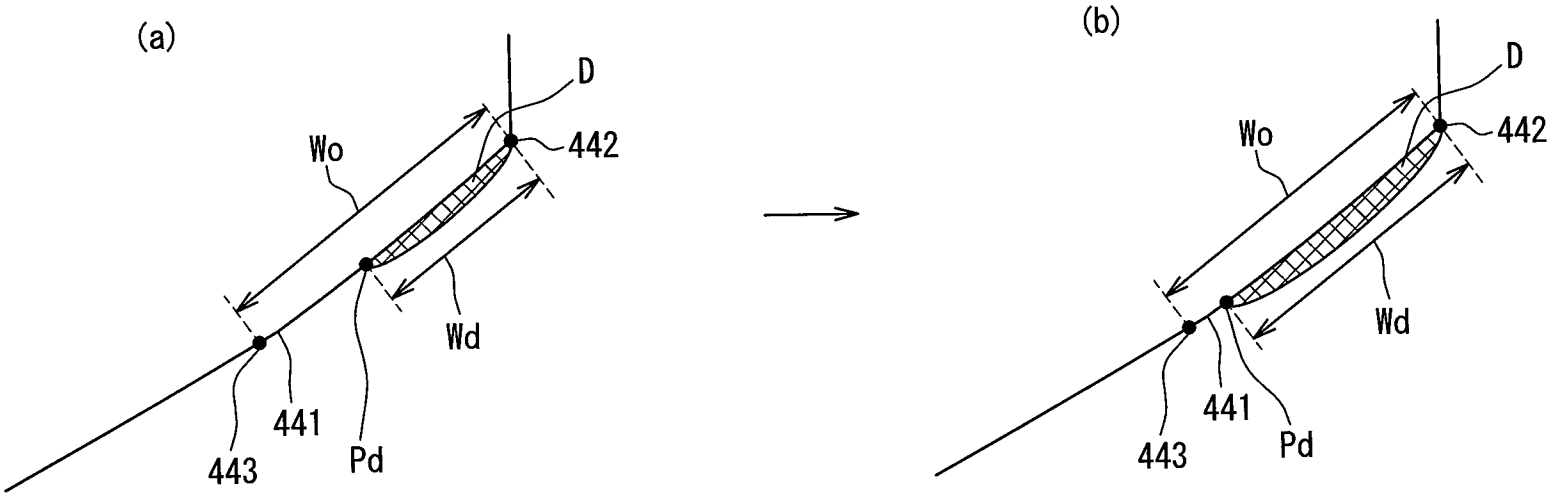
FIG. 8 is a schematic view for explaining volume growth of the deposit adhering to the outer convex surface of FIG. 4.
Figure 9:
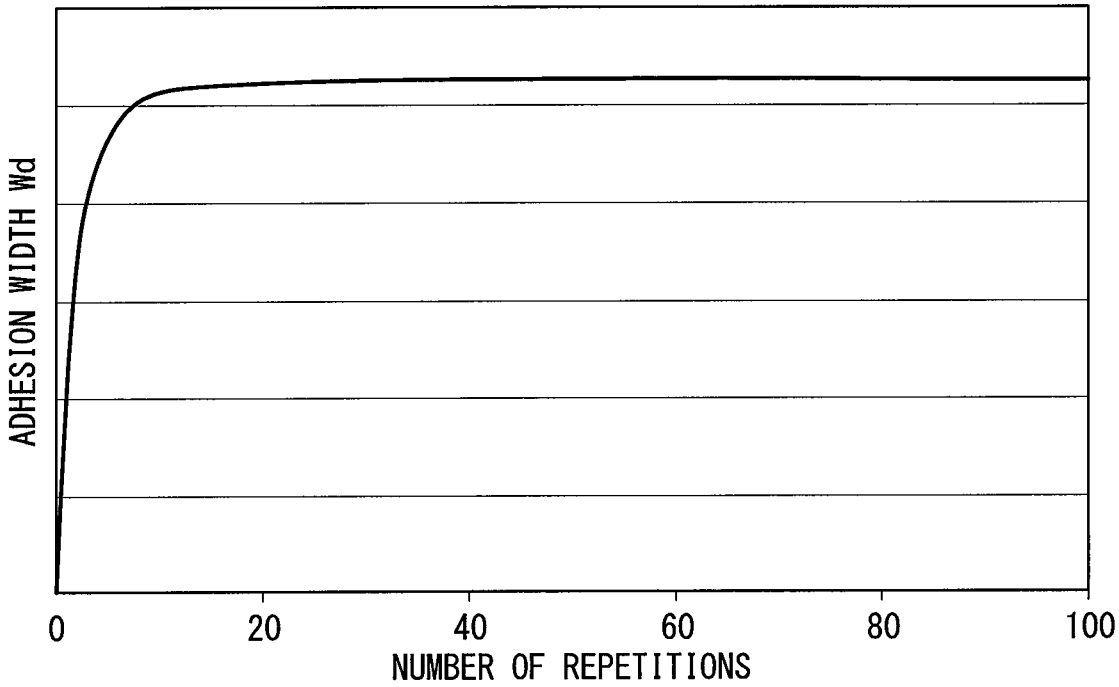
FIG. 9 is a graph for explaining adhesion width of the deposit adhering to the outer convex surface of FIG. 4.

It will be described about a relationship between the phenomenon of adhesion of a deposit such as fatty acid amide to the outer convex surface 441 and the outer peripheral side angle θo. As the outer peripheral side angle θo becomes smaller, a fuel, which flows between the outer convex surface 441 and the valve seat surface 16 during valve opening operation, tends to flow backward from the outer convex surface 441 as indicated by an arrow in FIG. 7. Since such backflow reduces the fluid force in the vicinity of the bent portion 442, a stay of the fuel flow occurs, thereby the deposit D is estimated to remain and adhere on the outer convex surface 441 as shown in FIG. 8(*a*). Such a remaining and adhering deposit D grows through deposition as shown in FIG. 8 (*b*) along with repetition of the valve opening operation. In FIG. 8, the deposit D is indicated by a cross-hatched portion.

However, when the number of repetitions of the valve opening operation increases to a certain degree, the adhesion width Wd from the bent portion 442 shown in FIG. 8 tends to be saturated on the outer convex surface 441 to which the deposit D adheres. This is presumably because the outer peripheral side angle θo apparently increases in the vicinity of the bent portion 442 by the growth through deposition of the deposit D, so that the stay of the fuel flow is less likely to occur. In the present embodiment, the adhesion width Wd of the deposit D is represented by a distance between the bent portion 442 and the most distant portion Pd of the deposit D from the bent portion 442 on the longitudinal section shown in FIG. 8.

Figure 10:
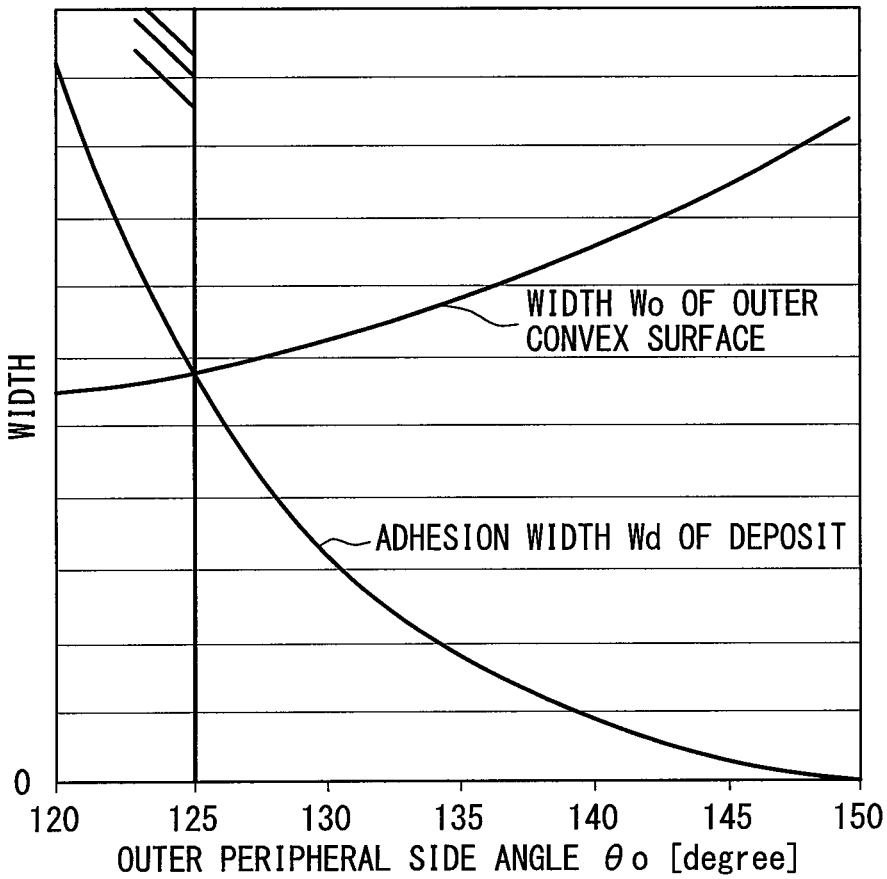
FIG. 10 is a graph for explaining the configuration of the contact portion of FIG. 2 or 3.

In the present embodiment, therefore, a distance between the bent portion 442 and the boundary portion 443, which is assumed as a width Wo of the outer convex surface 441 on the longitudinal section shown in FIG. 8, is necessary to be set larger than the adhesion width Wd of the deposit D. This is because if the width Wo of the outer convex surface 441 is smaller than the adhesion width Wd of the deposit D, the deposit D is caught between the boundary portion 443 and the valve seat surface 16 during the valve closing operation in which the boundary portion 443 collides with the valve seat surface 16, causing fuel leakage. Considering each of the bent portion 442 and the boundary portion 443 with a fixed radial distance from the valve center line Lv, therefore, the width Wo of the outer convex surface 441 and the adhesion width Wd of the deposit D each have a correlation with the outer peripheral side angle θo as shown in FIG. 10. Hence, it can be seen from such correlations that setting the outer peripheral side angle θo to 125° or more is a necessary configuration for suppressing fuel leakage not only from the viewpoint of the static contact pressure as described above but also from the viewpoint of the deposit D. The correlation of FIG. 10 appears when a difference of 0.09 mm or more in radial distance from the valve center line Lv is provided between the bent portion 442 and the boundary portion 443.

Figure 11:
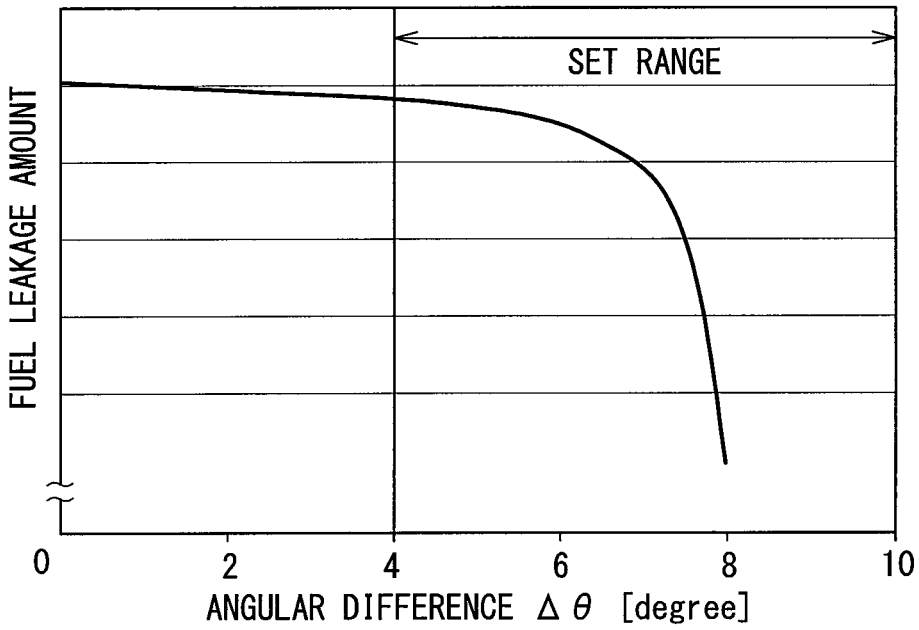
FIG. 11 is a graph for explaining the configuration of the contact portion of FIG. 2 or 3.

Furthermore, as shown in FIG. 5, a tangent line to the inner convex curved surface 440, which is assumed to extend through the boundary portion 443, is defined as an inner peripheral tangent line Li on the longitudinal section of the present embodiment. As shown in FIG. 5, an angle formed by the inner peripheral tangent line Li and the valve outer peripheral surface 46 on the longitudinal section is defined as inner peripheral side angle θi. Under such definitions on the inner convex surface 440 and the above-described definitions on the outer convex surface 441, as shown in FIG. 11, an angular difference Δθ between the inner peripheral side angle θi and the outer peripheral side angle θo is set within a range from 4° to 10°. For the angular difference Δθ of less than 4°, as shown in FIG. 11, a fuel leakage easily occurs from between the valve seat surface 16 and the boundary portion 443 between smooth and steep shapes. Hence, the angular difference Δθ of 4° or more is used to suppress a reduction in static contact pressure, which causes such fuel leakage. On the other hand, for the angular difference Δθ of more than 10°, since the boundary portion 443 increased in sharpness collides with the valve seat surface 16 and thus easily wears, the angular difference Δθ of 10° or less is used together with the outer peripheral side angle θo of 130° or less to securely suppress an excessive increase in dynamic contact pressure, which causes such wear. The fuel leakage amount shown on the vertical axis in FIG. 11 is represented by a volume of a fuel leaking within a predetermined time from between the boundary portion 443 and the valve seat surface 16 in a valve closed state, i.e., by a volumetric flow rate.

Figure 12:
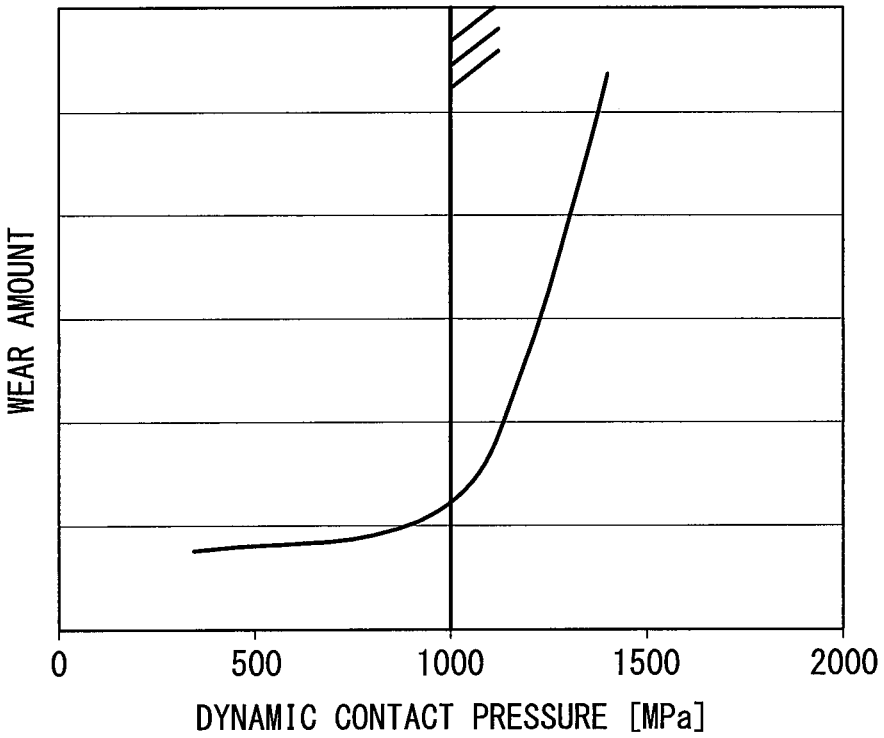
FIG. 12 is a graph for explaining a correlation between dynamic contact pressure and wear amount.

The dynamic contact pressure achieved by the above configuration of the present embodiment will be described. In general, in a state where the valve component is mostly inclined within the tolerance limit and thus its axis is deviated, the maximum of the dynamic contact pressure has a correlation with the wear amount as shown in FIG. 12. The present embodiment, therefore, limits the dynamic contact pressure, which is generated between the boundary portion 443 and the valve seat surface 16 during the valve closing operation in which the boundary portion 443 collides with the valve seat surface 16. That is, in the present embodiment, the dynamic contact pressure of more than 1000 MPa causing a remarkable wear amount is avoided, and the outer peripheral side angle θo is set to 130° or less while the angular difference Δθ is set to 10° or less in order to achieve a dynamic contact pressure of 1000 MPa or less. FIG. 12 shows a correlation between the maximum of the dynamic contact pressure for the inclination of the valve component of 0.1° and the wear amount represented as in FIG. 6.

(Functions and Effects)

Functions and effects of the fuel injection valve 1 as described above will be described below.

In the valve component 40 of the fuel injection valve 1, the outer convex surface 441 curved in a partial spherical shape with the curvature radius Ro smaller than that of the inner convex surface 440 is provided continuously to the outer peripheral side of the inner convex surface 440 curved in a partial spherical shape with a predetermined curvature radius Ri. As a result, the boundary portion 443 between the inner convex surface 440 and the outer convex surface 441 has a shape that protrudes toward the valve seat surface 16 but is reduced in sharpness. Hence, between the boundary portion 443 and the valve seat surface 16, the static contact pressure in the valve closed state, in which the boundary portion 443 is seated on the valve seat surface 16, can be increased within a suppressible range of the wear due to an excessive increase in dynamic contact pressure during the valve closing operation in which the boundary portion 443 collides with the valve seat surface 16. Consequently, a fuel leakage from between the boundary portion 443 and the valve seat surface 16 can be suppressed in the valve closed state.

The outer peripheral side angle θo formed by the outer peripheral tangent line Lo, which extends through the boundary portion 443, to the outer convex surface 441 and the valve outer peripheral surface 46 is set to 125° or more on the longitudinal section of the valve component 40 of the fuel injection valve 1. Consequently, the outer convex surface 441 may have a gap 151 (see FIG. 4) that increases as going from the boundary portion 443 to the outer peripheral side between the convex curved surface 441 and the valve seat surface 16 tapering toward the downstream side. Hence, even if the valve component 40 is inclined with respect to the valve seat surface 16 due to deviation of the biasing force of the elastic component 50, or the like, it is possible to suppress a reduction in static contact pressure due to contact between the valve seat surface 16 and the outer convex surface 441 on the outer peripheral side with respect to the boundary portion 443. Further, the outer peripheral side angle θo of 125° or more makes it possible to suppress catch of the deposit D, which grows through deposition on the outer convex surface 441, between the boundary portion 443 and the valve seat surface 16 during the valve closing operation. In addition, in the fuel injection valve 1, the outer peripheral side angle θo is set to 130° or less on the longitudinal section of the valve component 40. Consequently, the boundary portion 443 between the outer convex surface 441 and the inner convex surface 440 may have a shape reduced in sharpness. Hence, it is possible to improve reliability of the function of suppressing the wear due to an excessive increase in dynamic contact pressure between the boundary portion 443 and the valve seat surface 16. This can contribute to suppressing fuel leakage from between the boundary portion 443 and the valve seat surface 16 in the valve closed state.

Furthermore, the inner peripheral side angle θi formed by the inner peripheral tangent line Li, which extends through the boundary portion 443, to the inner convex surface 440 and the valve outer peripheral surface 46 is set to have the angular difference of 4° or more from the outer peripheral side angle θo on the longitudinal section of the valve component 40 of the fuel injection valve 1. Consequently, the boundary portion 443 between the inner convex surface 440 and the outer convex surface 441 securely has the shape protruding toward the valve seat surface 16. Hence, it is possible to improve reliability of the function of increasing the static contact pressure between the boundary portion 443 having such a protruding shape and the valve seat surface 16. Further, in the fuel injection valve 1, the inner peripheral side angle θi is set to have the angular difference of 10° or less from the outer peripheral side angle θo on the longitudinal section of the valve component 40. Consequently, the boundary portion 443 between the inner convex surface 440 and the outer convex surface 441 has a shape securely reduced in sharpness. Hence, it is also possible to improve reliability of the function of suppressing the wear due to an excessive increase in dynamic contact pressure between the boundary portion 443 and the valve seat surface 16. This can greatly contribute to suppressing fuel leakage from between the boundary portion 443 and the valve seat surface 16 in the valve closed state.

Further, in the fuel injection valve 1, it is possible to control the dynamic contact pressure, which is generated between the boundary portion 443 and the valve seat surface 16, to 1000 MPa or less during the valve closing operation in which the boundary portion 443 collides with the valve seat surface 16. Consequently, the function of suppressing the wear is securely exhibited, which can greatly contribute to suppressing fuel leakage from between the boundary portion 443 and the valve seat surface 16 in the valve closed state.

In addition, since the outer convex surface 441 with a small curvature radius Ro is continued from the valve outer peripheral surface 46 in a bending manner on the longitudinal section of the valve component 40, a gap 151 (see FIG. 4) increasing toward the outer periphery side can be provided between the convex curved surface 441 and the valve seat surface 16 tapering toward the downstream side. Hence, even if the valve component 40 is inclined with respect to the valve seat surface 16 due to deviation of the biasing force of the elastic component 50, or the like, it is possible to suppress a reduction in static contact pressure due to contact between the valve seat surface 16 and the bending portion 442 formed by the outer convex surface 441 and the valve outer peripheral surface 46. This can contribute to suppressing fuel leakage from between the boundary portion 443 and the valve seat surface 16 in the valve closed state.

In addition, in the fuel injection valve 1, even if the pressing force, which presses the valve component 40 in the valve closed state to the valve seat surface 16, decreases by a relatively low fuel pressure of the injected fuel into the intake port 2*b*, the function on the dynamic contact pressure and the static contact pressure can be exhibited between the boundary portion 443 and the valve seat surface 16. Consequently, it is also possible to suppress fuel leakage in the valve closed state under a configuration of a relatively low fuel pressure of the injected fuel.

OTHER EMBODIMENTS

Although one embodiment of the present disclosure has been described hereinbefore, the present disclosure should not be limitedly interpreted to that embodiment, and can be applied to various embodiments within the scope without departing from the gist of the present disclosure.

Specifically, in a first modification, the outer peripheral side angle θo may be set out of the range from 125° to 130° as long as the functions and the effects of the present disclosure are provided. In a second modification, the angular difference Δθ may be set out of the range from 4° to 10° as long as the functions and the effects of the present disclosure are provided. In a third modification, the dynamic contact pressure, which is generated between the boundary portion 443 and the valve seat surface 16 during the valve closing operation in which the boundary portion 443 collides with the valve seat surface 16, may be set to a contact pressure of more than 1000 MP as long as the functions and the effects of the present disclosure are provided.

Figure 13:
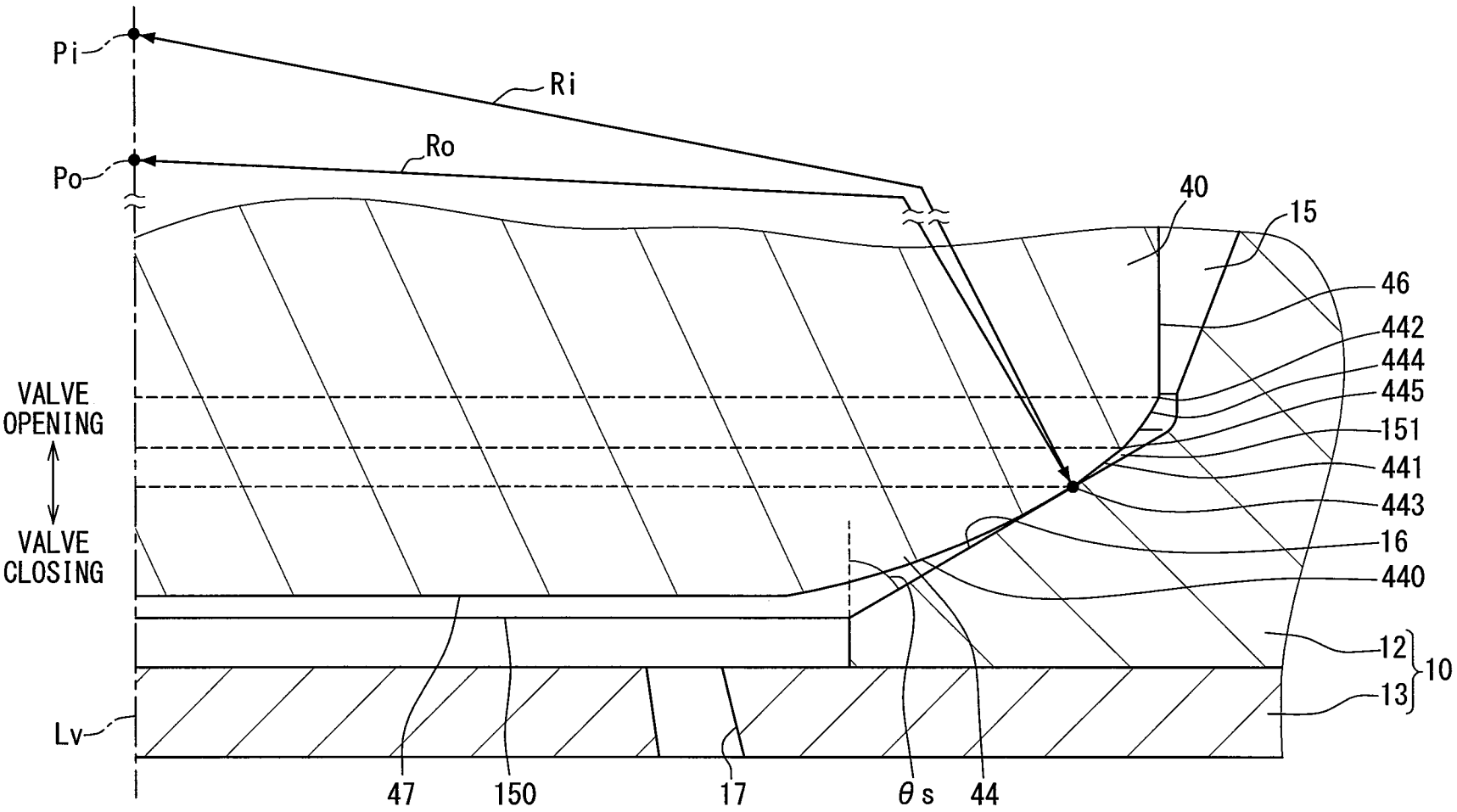
FIG. 13 is a longitudinal sectional view showing a modification of FIG. 4.

In a fourth modification, as shown in FIG. 13, an additional surface 444, which connects the outer convex surface 441 to the valve outer peripheral surface 46, may be provided on the outer peripheral side of the outer convex surface 441 and on the inner peripheral side of the valve outer peripheral surface 46 in the contact portion 44. As shown in FIG. 13, such an additional surface 444 may be formed in a convex curved surface shape such as a partial spherical shape having an arcuate section with a curvature radius that is further smaller than that of the outer convex surface 441 on the longitudinal section. Alternatively, while not shown, the additional surface 444 may be formed in a tapered surface shape, for example. In FIG. 13, a boundary portion between the outer convex surface 441 and the additional surface 444 is indicated by a reference numeral 445.

Figure 14:
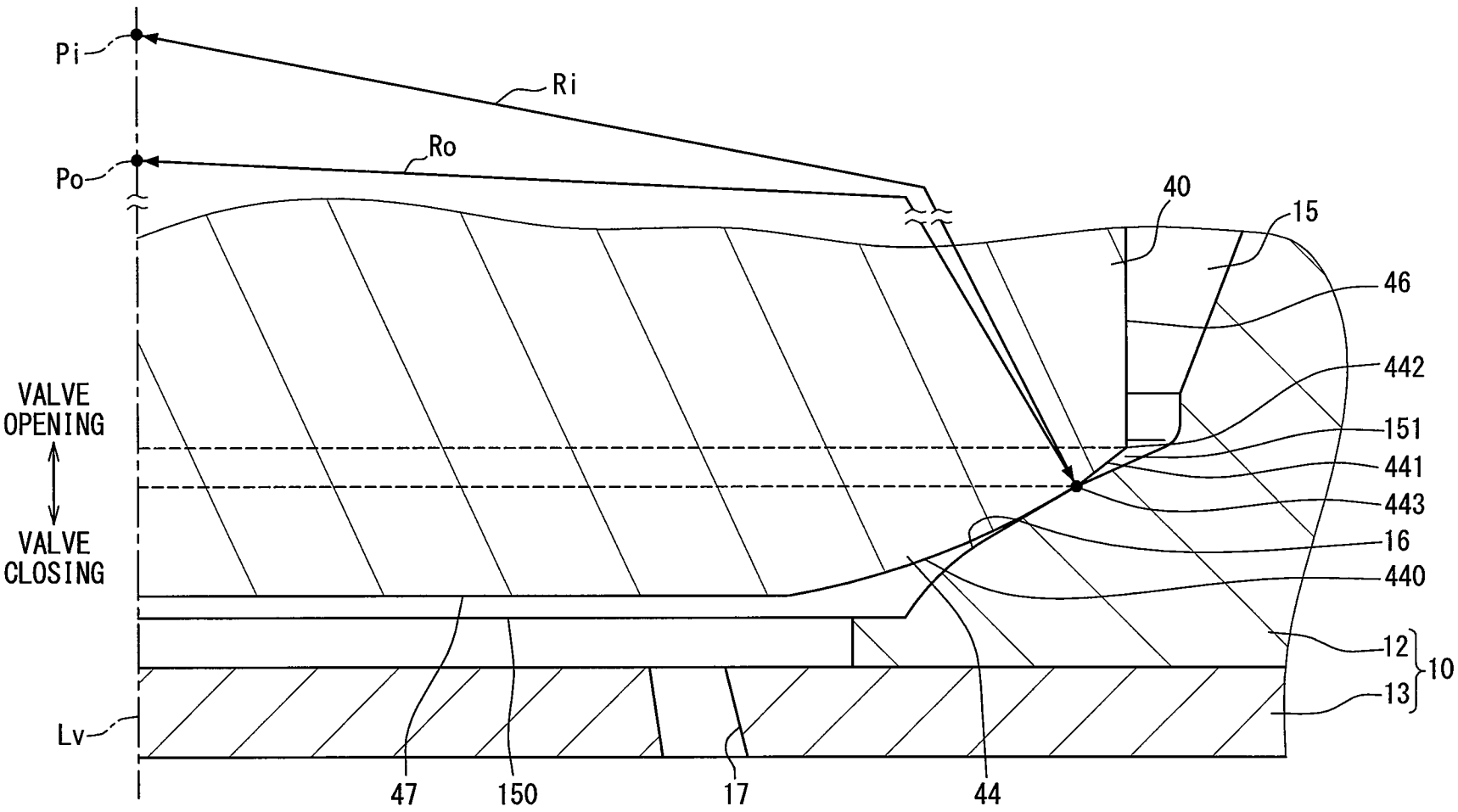
FIG. 14 is a longitudinal sectional view showing a modification of FIG. 4.
Figure 15:
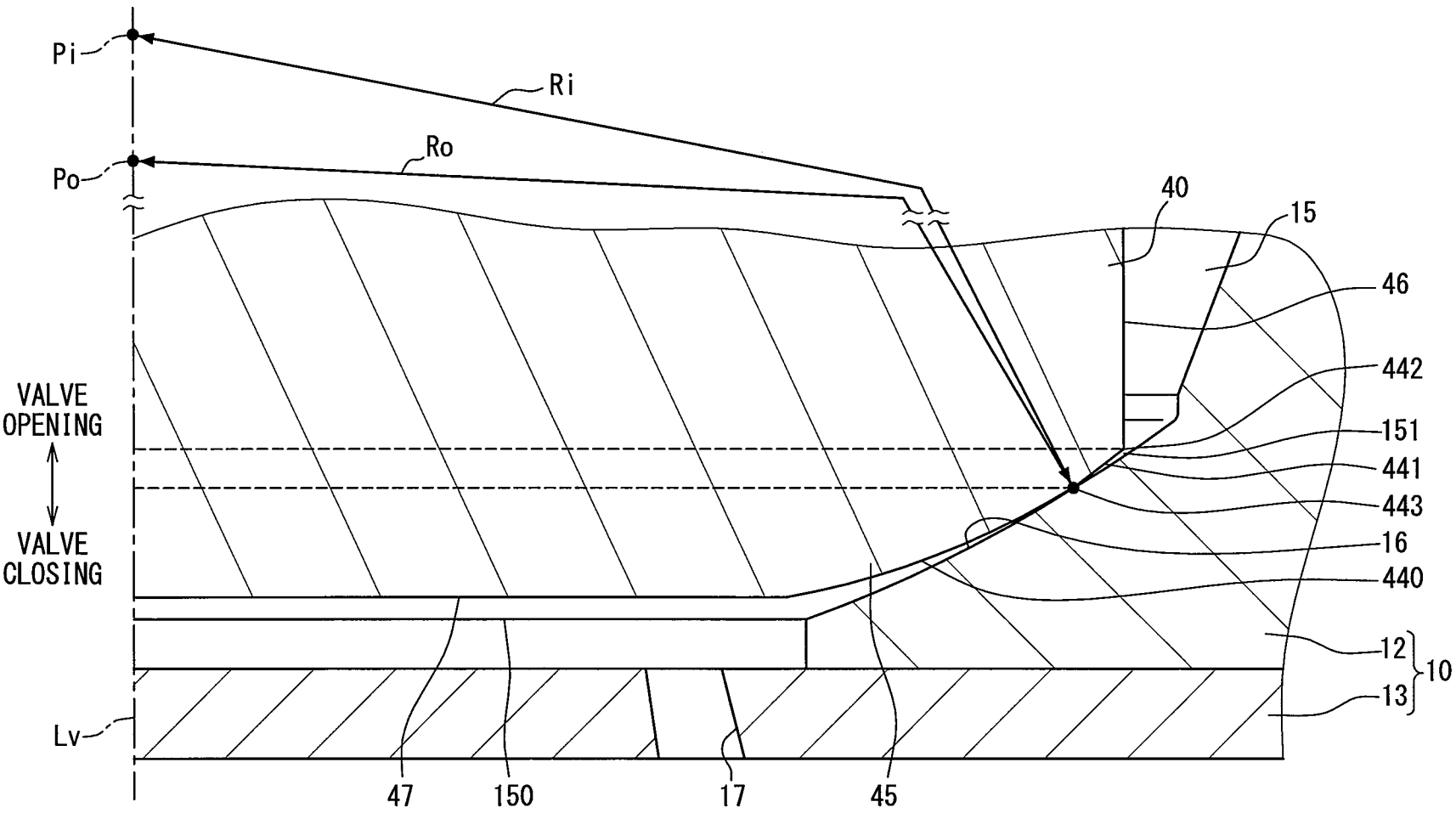
FIG. 15 is a longitudinal sectional view showing a modification of FIG. 4.

In a fifth modification, the valve seat surface 16 may be formed in a tapered surface shape having a taper angle θs other than 120°. In a sixth modification, as shown in FIG. 14, the valve seat surface 16 may be formed in a curved surface shape that tapers toward the downstream side of the fuel passage 15 at a taper rate decreasing toward the downstream side. In a seventh modification, as shown in FIG. 15, the valve seat surface 16 may be formed in a curved surface shape that tapers toward the downstream side of the fuel passage 15 at a taper rate increasing toward the downstream side.

In an eighth modification, the present disclosure may be applied to a fuel injection valve that injects fuel into a cylinder of a gasoline internal combustion engine. In a ninth modification, the present disclosure may be applied to a fuel injection valve that injects fuel into a cylinder of a diesel internal combustion engine.

The invention claimed is:

1. A fuel injection valve, comprising:

a valve housing having an injection hole injecting a fuel into an internal combustion engine and a valve seat surface tapering toward a downstream side on an upstream side with respect to the injection hole;

a valve component which is accommodated in the valve housing, and is coaxially separated from or seated on the valve seat surface for valve opening or valve closing to allow intermittent fuel injection from the injection hole; and an elastic component biasing the valve component toward the valve seat surface, wherein the valve component includes a cylindrical portion and a tip end, the tip end includes:

an inner convex surface curved in a partial spherical shape with a predetermined first curvature radius, an outer convex surface that is provided continuously to a valve peripheral surface of the cylindrical portion and further continuously to an outer peripheral side of the inner convex surface, the outer convex surface curved in a partial spherical shape having a constant second curvature radius smaller than the inner convex surface, a boundary portion between the inner convex surface and the outer convex surface protrudes toward the valve seat surface, and the constant second curvature radius of the outer convex surface extends continuously between the cylindrical portion and the boundary portion; and the tip end of the valve component is able to be seated on the valve seat surface only at the boundary portion.

2. The fuel injection valve according to claim 1, wherein an outer peripheral tangent line, which extends through the boundary portion, to the outer convex surface is defined on a longitudinal section of the valve component, an outer peripheral side angle formed by a valve outer peripheral surface of the valve component and the outer peripheral tangent line is defined on the longitudinal section of the valve component, and the outer peripheral side angle is set within a range from 125° to 130°.

3. The fuel injection valve according to claim 2, wherein an inner peripheral tangent line, which extends through the boundary portion, to the inner convex surface is defined on the longitudinal section of the valve component, an inner peripheral side angle formed by the valve outer peripheral surface of the valve component and the inner peripheral tangent line is defined on the longitudinal section of the valve component, and an angular difference between the inner peripheral side angle and the outer peripheral side angle is set within a range from 4° to 10°.

4. The fuel injection valve according to claim 1, wherein a dynamic contact pressure, which is generated between the boundary portion and the valve seat surface during valve closing operation in which the boundary portion collides with the valve seat surface, is controlled to 1000 MPa or less.

5. The fuel injection valve according to claim 1, wherein the outer convex surface is continued from a valve outer peripheral surface of the valve component in a bending manner.

6. The fuel injection valve according to claim 1, wherein the injection hole injects fuel into an intake port of the internal combustion engine.

7. The fuel injection valve according to claim 1, wherein the valve seat surface is in a curved surface shape that tapers toward a downstream side of the fuel passage at a taper rate decreasing toward the downstream side.

8. The fuel injection valve according to claim 1, wherein the valve seat surface is in a curved surface shape that tapers toward a downstream side of the fuel passage at a taper rate increasing toward the downstream side.

9. The fuel injection valve according to claim 1, wherein the boundary portion has a protruding shape, which is formed by the outer convex surface and the inner convex surface with the outer convex surface having the smaller second curvature radius smaller than the inner convex surface such that the curvature radius changes at the boundary portion; and the protruding shape protrudes toward the valve seat surface.

* * * * *